US005178196A

United States Patent [19]

Garacci

[11] Patent Number: 5,178,196

[45] Date of Patent: Jan. 12, 1993

[54] APPARATUS FOR FILLING AND EMPTYING CONTAINERS

[75] Inventor: Patrice Garacci, Memphis, Tenn.

[73] Assignee: Inter-Pac Packaging Corporation, Memphis, Tenn.

[21] Appl. No.: 686,994

[22] Filed: Apr. 18, 1991

[51] Int. Cl.[5] ..... B65B 1/08; B65B 31/00

[52] U.S. Cl. ..... 141/67; 141/59; 406/86

[58] Field of Search ..... 141/59, 65, 67; 406/82, 406/117, 86, 88, 89, 87, 154, 155, 156, 157; 193/35 J, 36; 198/339.1, 346.1, 346.2, 782

[56] References Cited

U.S. PATENT DOCUMENTS

| | | | |
|---|---|---|---|
| 2,298,921 | 10/1942 | Barker | 193/35 J |
| 3,180,688 | 4/1965 | Futer | 406/88 |
| 3,181,916 | 5/1965 | Epstein | 302/29 |
| 4,392,760 | 7/1983 | Futer | 406/88 |
| 4,799,830 | 1/1989 | Fuss | 406/117 |
| 4,846,334 | 7/1989 | Cargould | 198/346.2 |
| 4,934,875 | 6/1990 | Fuss | 406/117 |
| 4,947,903 | 8/1990 | Beckwith | 141/59 |

FOREIGN PATENT DOCUMENTS

| | | | |
|---|---|---|---|
| 1009942 | 4/1983 | Bulgaria | 406/154 |

*Primary Examiner*—Henry J. Recla
*Assistant Examiner*—David J. Walczak
*Attorney, Agent, or Firm*—Walker, McKenzie & Walker

[57] ABSTRACT

A filler material dispensing and recycling machine including an emptying table with louvers for directing a flow of air over the surface of the table. Incoming packages may be emptied on the table, the items packed therein removed from the filler material which also was therein, and then the air flow sweeps the filler material from the table and back into a filler material hopper. Outgoing containers may also be packed with filler material, arriving on a conveyor, passing under a dispensing tube connected to the filler material hopper, filled with filler material from the hopper, and then traveling onward on the conveyor. A collection hopper adjacent the edge of the emptying table collects filler material swept off the table, and presents the filler material to an air conveyor system which carries the filler material back to the filler material hopper. Removable rollers may be placed above the emptying table, creating a filling configuration which allows packages to be filled with filler material from the dispensing tube, with overflow filler material passing through the rollers and then being recycled by the air conveyor system to the filler material hopper. With the removable rollers removed, an emptying configuration is created, allowing containers to be emptied on the emptying table. Pressurized plenums with angled louvered slits therein direct the flow of air over the emptying table and along the air conveyor system.

14 Claims, 3 Drawing Sheets

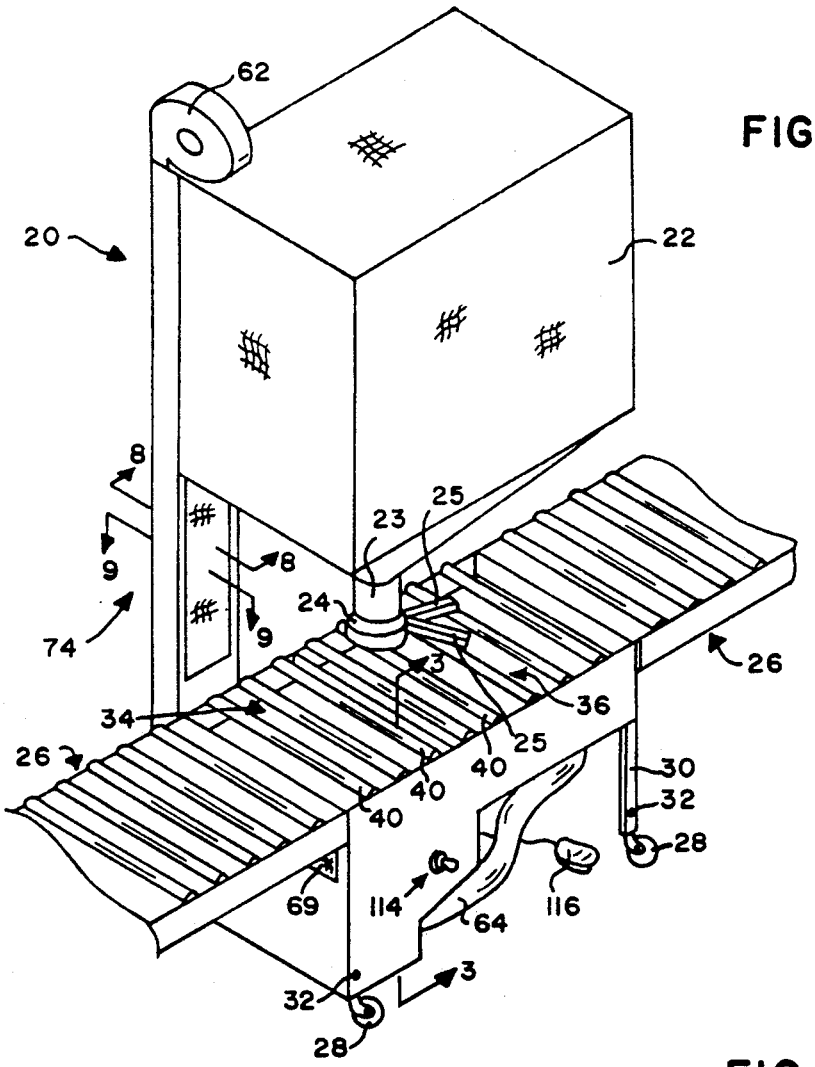
FIG. 1
FIG. 2
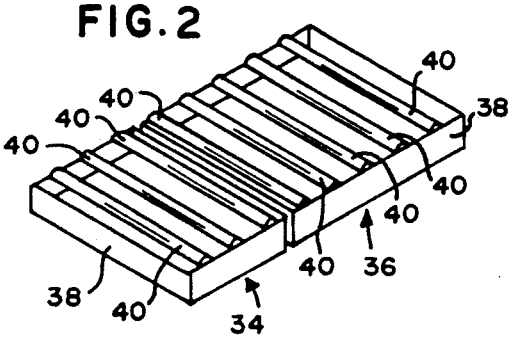
FIG. 3
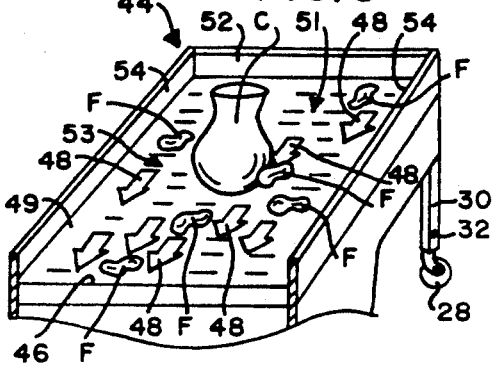

FIG. 4
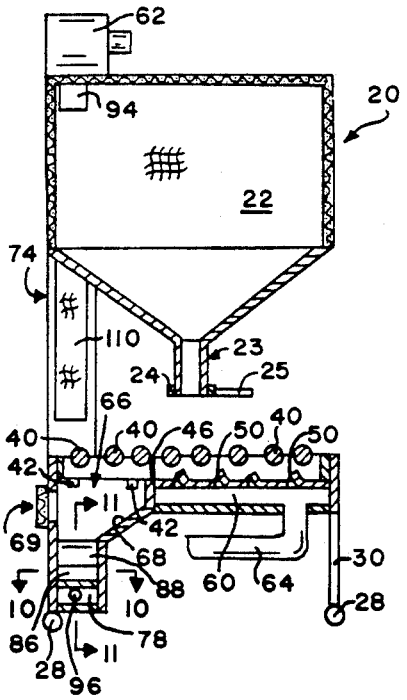
FIG. 5
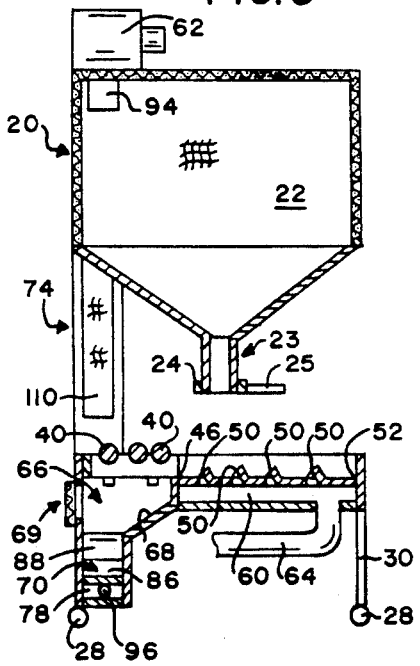
FIG. 6
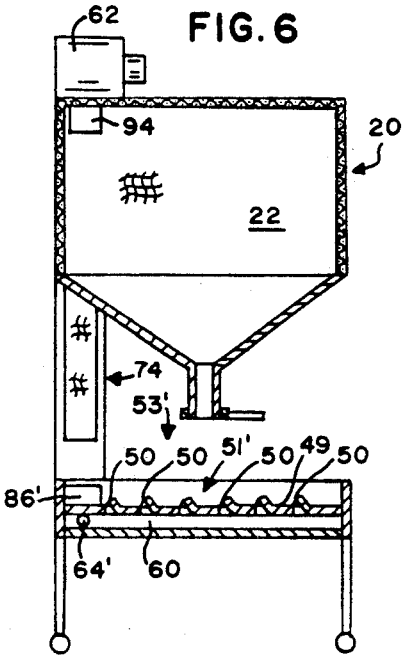
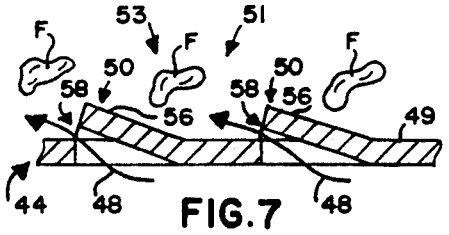
FIG. 7
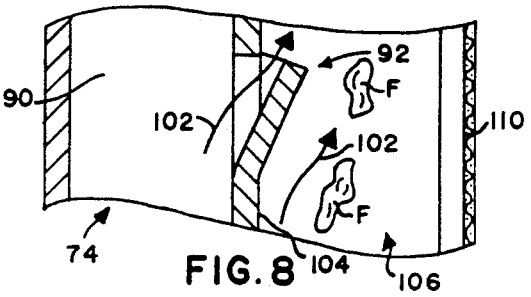
FIG. 8

APPARATUS FOR FILLING AND EMPTYING CONTAINERS

BACKGROUND OF THE INVENTION

1. Field of the Invention

The present invention relates, in general, to apparatus for dispensing filler material and for also emptying containers containing such filler material, and in particular, to an apparatus adaptable to be used for recycling filler material either from the contents of containers unloaded from a conveyor or from containers being loaded while on a conveyor.

2. Information Disclosure Statement

Manufacturers and shippers often pack items in packages with filler packing material, such as polystyrene "peanuts," popcorn, extruded corn starch, or other lightweight filler material; it is also common to have generalized containers, such as, for instance, "bean bag" chairs, filled with lightweight filler material. It will be understood that the terms "packing material" and "filler material," as used herein, are intended to refer to all such similar lightweight filler materials used to fill containers or to pack items within containers for shipping or transport. It will be similarly understood that the terms "packages" and "containers," as used herein generally refer both to packages used in shipping items as well as generalized containers and bags, as, for example, the aforementioned "bean bag" furniture.

It is desirable for shipping and receiving departments of such manufacturers and shippers to be able to both pack outgoing items and also to unpack incoming items; for environmental reasons, such manufacturers would prefer to recycle not only the excess spillage of packing material used in the packing operation, but also to re-use packing material removed from incoming packages when filling other outgoing packages. It is also desirable that packing and unpacking be possible at the same work area, and that the time spent packing and unpacking be minimized for maximum throughput and efficiency.

It is also often desirable to fill containers, as, for instance, the outer skin of "bean bag" furniture, with lightweight filler material during manufacture or refurbishment.

Well-known solutions for packing items within packages include dispensers, filled with packing material, having a dispensing valve through which packing material flows into packages on, for instance, a conveyor below. Such dispensing systems inherently create spillage of packing material that must be periodically collected.

Previous solutions, though, have addressed the packing or filling aspects of the problem alone, neglecting the similar problems which occur during unpacking of packages or emptying of containers. As incoming packages are opened in a receiving department, workers must typically dig through the packages and their associated packing material searching for the items therein, an often time-consuming process, occasionally spilling the packing material within the work area. The packing material is then generally tossed into the garbage along with the package, without recycling.

It is desirable to have some means for quickly separating the packing material from the items packed within a package, and then recycling the packing material for reuse. It is also desirable that a work station for unpacking and packing be easily adjustable for integration with an existing conveyor system, so that packages may arrive and leave the packing and unpacking area in a smooth flow. When used in the context of generally filling and emptying containers with filler material, it is similarly desirable to easily fill the container, recycling any excess spillage, or empty the container, again, recycling the removed filler contents. Preferably, such a work station should be easily movable for cleaning or reconfiguration of the work area.

A preliminary patentability search in Class 406, subclasses 82 and 117, as well as Class 141, subclass 67, produced the following patents, some of which may be relevant to the present invention: Fuss, U.S. Pat. No. 4,799,830, issued Jan. 24, 1989; Fuss, U.S. Pat. No. 4,934,875, issued Jun. 19, 1990; and Beckwith, U.S. Pat. No. 4,947,903, issued Aug. 14, 1990.

Additionally, Epstein, U.S. Pat. No. 3,181,916, issued May 4, 1965, describes an air conveyor for small, light articles such as from a molding machine.

While each of the above patents disclose various apparatus for use with packing or filler material and filling containers or packages therewith, as well as various air conveyor apparatus, none disclose or suggest the present invention. More specifically, none of the above patents disclose or suggest an apparatus adaptable to be used for recycling packing or filler material either from the contents of packages or containers unloaded from a conveyor or from packages or containers being loaded while on a conveyor, said apparatus having an emptying table comprising a surface for receipt of the contents of the containers and further comprising air means for directing a flow of air over the surface and into the apparatus, thereby recovering packing material during the unpacking or packing process.

Fuss, U.S. Pat. No. 4,799,830, and Fuss, U.S. Pat. No. 4,934,875, describe an air conveyor dispensing and recycling system with various air transport mechanisms for packing material. Unlike the present invention, which provides a surface for unloading packages and recovering the packing material therefrom, as well as the ability to load packages with packing material, the Fuss patents only describe recycling apparatus applicable for use in the packing of packages and the collection of associated packing material spillage.

Beckwith, U.S. Pat. No. 4,947,903, describes a packing material dispensing bin for filling containers with packing material, combined with a suction hose which an operator may use to recover excess spilled filler material which overflows the containers.

Epstein, U.S. Pat. No. 3,181,916, describes an air conveyor apparatus having louvered slits, but limits the disclosure to an article conveyor itself which also cools heated molded articles emerging from a molding machine, without mention of packing, unpacking, recycling of packing material, or even packing material.

SUMMARY OF THE INVENTION

The present invention is an emptying table, either for use with, or as a part of, a filler material dispensing and recycling machine such as might be found in a shipping and receiving department. The recycling machine includes dispensing means for dispensing filler material into a container, said dispensing means comprising a filler material hopper for holding filler material, and valve means attached to the filler material hopper for allowing filler material to flow from the filler material hopper into the container.

The emptying table has a surface on which the contents of a received package may be emptied, allowing any items shipped therein to be efficiently removed from the filler material also therein. The emptying table also comprises means for directing a flow of air over the surface of the table and toward an edge of the table, thereby causing filler material on the surface to flow along the surface and toward the edge. The filler material is then recycled back into the filler material hopper by air conveyor means, thereby allowing filler material which is received in one package to be reused in an outgoing package.

Similarly, during the filling of outgoing packages or containers, excess filler material which overflows the containers onto the emptying table is swept from the emptying table to the air conveyor means, again for recycling back into the filler material hopper. A removable roller transport assembly means may be placed over the emptying table when only filling is to be performed, allowing containers to be transported from an incoming conveyor, through the recycling machine, and back onto an outgoing conveyor.

It is an object of the present invention to provide an emptying table for separating filler material within packages from items shipped therein, or for receipt of filler material from containers. It is a further object that means be provided for recycling the filler material thus separated for future use in filling other outgoing containers.

When combined with a filler material dispensing and recycling machine, it is an object of the present invention that the resulting work station be adjustable for integration and mating with conveyor systems such as might be found in a shipping or receiving department, and that the work station be movable for cleaning or reconfiguration.

BRIEF DESCRIPTION OF THE DRAWINGS

FIG. 1 is a perspective view of a filler material dispensing and recycling machine with the present invention installed.

FIG. 2 is a perspective view of the two removable roller transport assemblies.

FIG. 3 is a perspective view of the emptying table of the present invention, taken along the partial view lines 3—3 shown in FIG. 1, showing air flow from the louver means therein.

FIG. 4 is a front sectional view of the filler material dispensing and recycling machine showing the emptying table and collection hopper.

FIG. 5 is another front sectional view of the filler material dispensing and recycling machine, similar to FIG. 4, except with one of the removable roller transport assemblies shown removed.

FIG. 6 is a front sectional view of an alternate embodiment of the present invention in which the collection hopper is not present.

FIG. 7 is a sectional view of a portion of the emptying table, showing the detail of the louver means.

FIG. 8 shows a side sectional view of a portion of the filler material vertical transport column, taken along the lines 8—8 shown in FIG. 1.

DESCRIPTION OF THE PREFERRED EMBODIMENT

Figure 9:
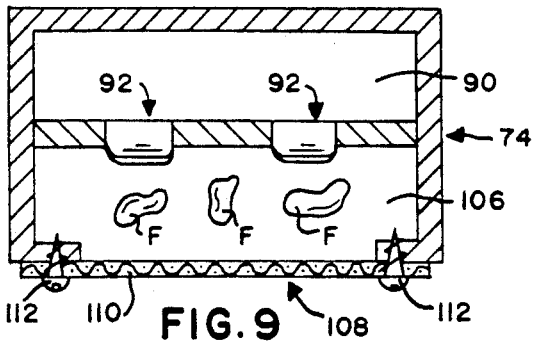
FIG. 9 shows a top sectional view of a portion of the filler material vertical transport column, taken along the lines 9—9 shown in FIG. 1.
Figure 10:
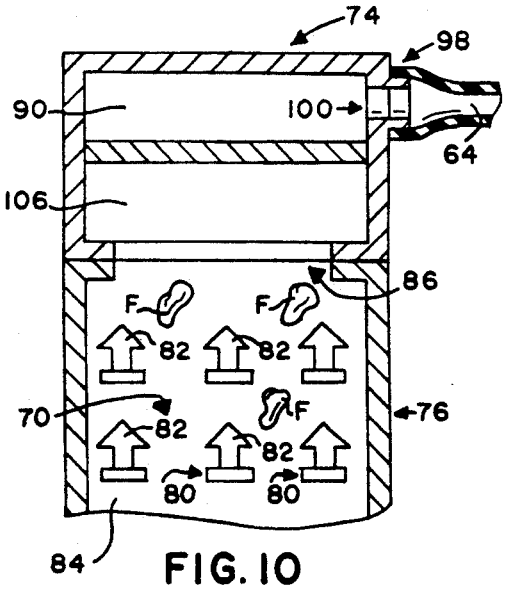
FIG. 10 shows a top sectional plan view of the intersection of the collection hopper and horizontal transport bed with the lower end of the filler material vertical transport column, taken along the lines 10—10 shown in FIG. 4.

Referring to FIG. 1, the filler material dispensing and recycling machine 20 is seen to comprise a filler material hopper 22, preferably of cloth or screen, for holding filler material, and valve means 24, well known to those skilled in the art, interposed within dispensing tube 23 which, in turn, is in communication with the interior of filler material hopper 22. Valve means 24 is for allowing the filler material within the filler material hopper to flow through dispensing tube 23 into a package or packing container placed below valve means 24 and dispensing tube 23. It will be understood that the terms "packing material" and "filler material," as used herein, are intended to refer generally to lightweight filler material such as polystyrene "peanuts," popcorn, extruded corn starch, and other similar lightweight filler materials used to fill containers or to pack items within containers for shipping or transport. It will be similarly understood that the terms "packages" and "containers," as used herein, generally refer both to packages used in shipping items as well as generalized containers and bags, as, for example, the well known "bean bag" style furniture. Valve means 24 may be manually operated by actuator arms 25 or any automatic system, as for example, by a pneumatic cylinder, allowing filler material to flow by gravity from the filler material hopper through dispensing tube 23 in a manner that will now be apparent. It will also be understood that valve means 24 may alternatively be left open for a continuous flow of filler material from dispensing tube 23.

Recycling machine 20 may be used as a shipping and receiving work station, and may be interposed between portions 26 of a conveyor system, such as a roller conveyor system as shown, which might be found in a shipping and receiving department. For portability, recycling machine 20 preferably has wheels or casters 28 which may be attached to telescoping legs 30. Telescoping legs 30 may be fixed at a given length by interlocking means such as well known spring-loaded protrusions or screws 32 for securing the telescoping part of legs 30 together, in a manner that will now be apparent, thereby allowing the recycling machine to compatibly mate at a similar height with portions 26 of the conveyor system.

Recycling machine 20 also preferably has a first and a second removable roller transport assembly means, 34 and 36, respectively, for moving a container from one of portions 26 of the conveyor system, under valve means 24 and dispensing tube 23, allowing filling of the container with filler material, and then on to the other of the portions 26 of the conveyor system. Roller means 34 and 36 each include a frame 38 and one or more rollers 40, well known to those skilled in the art, mounted in frame 38 and rotating on ball bearing means, not shown, also well known to those skilled in the art. Preferably, roller means 34 may rest on tabs 42 shown in FIG. 4.

FIG. 3 shows the emptying table 44 of the present invention, with a package or container C resting thereon. Filler material F, here represented, by way of example, by polystyrene peanuts such as may have come from within container C, packing an item therein, is urged toward an edge 46 of emptying table 44 by an air flow 48 passing over the surface 49 of emptying table 44. Air means 51 for directing air flow 48 over the surface 49 of emptying table 44 preferably is chosen to be louver means 53 comprising one or more louvers 50, hereinafter described, of emptying table 44, or air flow 48 may emanate, as will be understood by those skilled in the art, from one or more air nozzles, not shown, located at opposite end 52 or sides 54 of emptying table 44, directed over surface 49 of emptying table 44 toward edge 46.

Referring to FIGS. 4 and 7, louvers 50 are seen to preferably resemble similar louvers found on a well known air conveyor system. As a point of reference, there are also certain similarities between louvers 50 and the cutting louvers found on a well known cheese grater, such as might be found in a kitchen. Louvers 50 comprise angled louvered portions 56, preferably deformed portions of table 44 angled so as to direct air flow 48 at an angle and over the surface 49 of table 44. Louvered portions 56 are seen to define angled slits or openings 58, through surface 49, through which air flow 48 passes as it exits from pressurized plenum 60. It should be understood that louvered portions 56 may either project upwardly toward edge 46 as shown, or downwardly into plenum 60 and away from edge 46, since, as will now be understood, either configuration causes air flow 48 to be directed over surface 49 of table 44 and toward edge 46, thereby urging filler material F on surface 49 toward edge 46.

Pressurized plenum 60 is preferably constructed as shown, with the upper surface of plenum 60 serving as the surface 49 of emptying table 44. A source of air for pressurizing plenum 60, such as blower 62, is connected to plenum 60 through air hose 64 which, in turn, is in communication with the interior of plenum 60 and interposed between blower 62 and plenum 60.

A collection hopper 66 may be located adjacent edge 46 for receipt and collection of filler material which leaves edge 46. Collection hopper 66 may have a sloping side 68 for directing the filler material into the bottom portion 70 of collection hopper 66, and may also have a screened opening 69 along one side.

Filler material which is collected in the bottom portion 70 of collection hopper 66 is then presented to air conveyor means 72 for moving the filler material, which has departed edge 46 of table 44, back to filler material hopper 22. Air conveyor means 72 preferably comprises vertical transport column 74 as well as horizontal transport bed means 76, at bottom portion 70 of collection hopper 66, for moving filler material F toward vertical transport column 74.

Figure 11:
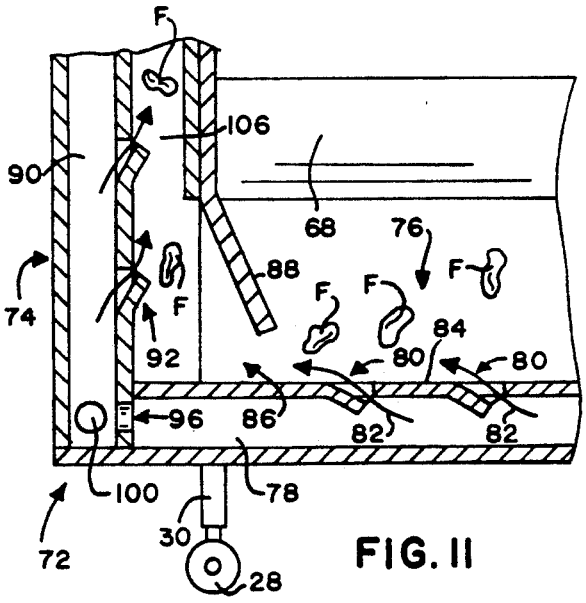
FIG. 11 shows a partial side sectional view of the intersection of the collection hopper and horizontal transport bed with the lower end of the filler material vertical transport column, taken along the lines 11—11 shown in FIG. 4.

Referring now to FIG. 11, horizontal transport bed means 76 preferably comprises a pressurized air plenum 78, in communication with an air source such as blower 62. Similar to emptying table 44, horizontal transport bed means 76 includes air means, preferably louver means 80, for directing a flow of air 82 along the surface 84 of horizontal transport bed means 76, thereby urging filler material F within the bottom portion 70 of collection hopper 66 toward opening 86 into vertical transport column 74. It should be noted that louver means 80, rather than being upwardly sloping toward opening 86, are preferably downwardly sloping away from opening 86, but still direct flow of air 82 along surface 84 toward opening 86. Hopper 66 may also preferably have a sloping portion 88 for directing filler material above opening 86 away from opening 86.

Vertical transport column 74, portions of which are shown in FIGS. 8 through 11, includes a pressurized air plenum 90 having air means, preferably such as louver means 92 similar to those on table 44 and horizontal transport bed means 76, for urging filler material F upwardly from opening 86, through opening 94 at the top of column 74 joining column 74 with filler material hopper 22, and into hopper 22. Plenum 90, like plenums 78 and 60, is pressurized by an air source such as blower 62 in communication with plenum 90, and preferably supplies a pressurized source of air to plenums 78 and 60 through opening 96 between plenums 9 and 78, as well as coupling 98 defining an opening 100 between hose 64 plenum 90, in a manner that now will be apparent, allowing the single air source 62 to pressurize all three plenums. Louver means 92 directs an air flow 102 upwardly along a surface 104 of vertical column 74, thereby urging filler material F upwardly within enclosed transport region 106 of vertical column 74. Preferably, transport region 106 includes a side with an opening 108 covered with screen 110, screen 110 being attached to vertical column 74 by securing means such as screws 112. Blower 62 may have a switch 114, wired in series between blower 62 and its source of power in a manner well known to those skilled in the art, allowing blower 62 to be turned on and off, or may have a foot switch 116, similarly wired in a manner well known to those skilled in the art, allowing momentary operation of blower 62 as desired when filler material needs to be recycled back into hopper 22.

It can now be seen that filler material, as it passes over edge 46 of emptying table 44, falls into collection hopper 66, which presents the filler material to air conveyor means 72, comprising horizontal transport bed means 76 and vertical transport column 74, which transports the filler material from collection hopper 66 back to filler material hopper 22.

In an alternate embodiment shown in FIG. 6, hopper 66 is omitted, and air means 51', preferably a plurality of louver means 53', for directing a flow of air across surface 49 of emptying table 44 and toward opening 86' into transport region 106 of vertical column 74. It should be understood that in this alternate configuration, not all of louvers 50 may be parallel, as they preferably will be in the first aforementioned embodiment in which they direct air flow toward edge 46, but instead that the relative position of each will be chosen to direct the air flow, which each emits over surface 49, toward opening 86', in a manner that now will be apparent to those skilled in the art. In other words, louvers 50 could be organized in concentric arcs, each louver 50 radially directing a flow of air inwardly toward a center point at opening 86', so that as filler material is urged by the flow of air to leave the edge of emptying table 44 into opening 86', the filler material is then carried upwardly by air conveyor means, now comprising vertical transport column 74, into hopper 22. Also, in the alternate embodiment, air hose 64 may be omitted, and plenum 60 may be supplied air through hole 64' connecting plenum 60 with plenum 90.

Machine 20 may be configured in either an emptying or a filling configuration. In the filling configuration, shown in FIGS. 1 and 4, roller transport assembly means 36 is supported above emptying table 44, allowing containers to smoothly pass from one portion 26 of conveyor system, under valve means 24 and dispensing tube 23 where the container is filled with filler material, and then on to the other portion 26 of the conveyor system. Any spillage of filler material will pass through rollers 40 onto table 44 and into hopper 66 and then be recycled back into hopper 22 in a manner previously described. In the alternate embodiment of the invention, the filler material will, of course, pass directly from table 44 into vertical column 74 through opening 86', and then into hopper 22, also in a manner previously described. It should be understood that frame 38 of roller means 36 may rest directly on table 44 or may be supported by a ledge (or other supporting means well known to those skilled in the art) above table 44 along sides 52, 54 of table 44.

In the emptying configuration, shown in FIGS. 5 and 6, roller means 36 is removed from above emptying table 44, allowing the contents of an incoming package to be dumped on the emptying table and the items packed therein to be quickly and efficiently separated from the filler material. When used in the emptying configuration, blower 62 may be turned off, preventing lightweight items from within the incoming package from being swept with the filler material back into filler material hopper 22, and foot switch 116 may be used to then dispose of the filler material once any items have been separated therefrom. Alternatively, blower 62 may remain continuously running for heavier items which will, of their own weight, tend not to be swept off of table 44 with the filler material. Preferably, for ease of use, the surface 49 of emptying table 44 will be horizontal, preventing items from rolling off the emptying table.

It should be noted that the emptying configuration may also be used to pack articles within containers, but, without roller means 36 in place above emptying table 44, the containers must be manually lifted from conveyor system portion 26 and placed on the emptying table, under dispensing tube 23, then lifted again and placed back onto the other conveyor system portion 26. Normally, roller means 34 remains in place above hopper 66 unless access is desired to hopper 66, in which case it may be easily removed.

It should be noted that filler material hopper 22 periodically requires refilling, since its contents are used to pack outgoing packages. With the present invention, this refilling is easily accomplished merely by emptying one or more bags of filler material on the emptying table or into the collection hopper, at which point air conveyor means 72 will transport the filler material up into hopper 22. For emptying the filler material into collection hopper 66, roller means 34 is easily removable from above hopper 66, allowing bags of filler material to be emptied into the hopper and swept up into hopper 22 in a manner that now will be apparent.

Although the present invention has been described and illustrated with respect to a preferred embodiment and a preferred use therefor, it is not to be so limited since modifications and changes can be made therein which are within the full intended scope of the invention

I claim:

1. A filler material dispensing and recycling machine, said recycling machine comprising:

a. filler material dispensing means for dispensing filler material into a container, said dispensing means comprising:

i. a filler material hopper for holding filler material, and ii. valve means attached to the filler material hopper for allowing the filler material to flow from the filler material hopper into the container;

b. an emptying table, said emptying table comprising a surface for receipt of the contents of the container, said contents comprising filler material; said emptying table further comprising air means for directing a flow of air emanating from said air means over the surface toward an edge of the emptying table, thereby urging the filler material of the contents, which have been placed on the surface, along the surface and toward the edge of the emptying table; and, c. air conveyor means for moving the filler material which leaves the edge of the emptying table into the filler material hopper.

2. A filler material dispensing and recycling machine, said recycling machine comprising:

a. filler material dispensing means for dispensing filler material into a container, said dispensing means comprising:

i. a filler material hopper for holding filler material, and ii. valve means attached to the filler material hopper for allowing the filler material to flow from the filler material hopper into the container;

b. an emptying table, said emptying table comprising a plenum for pressurization by a source of air, said plenum having an upper surface for receipt of the contents of the container, said contents comprising filler material; said upper surface of said plenum having louver means for directing a flow of air from within the plenum, at an angle over the upper surface and toward an edge of the emptying table, thereby urging the filler material of the contents, which have been placed on the upper surface, along the upper surface and toward the edge of the emptying table; and, c. air conveyor means for moving the filler material which leaves the edge of the emptying table into the filler material hopper.

3. The machine of claim 2, in which the louver means is a plurality of angled slits through the upper surface.

4. The machine of claims 2 or 3, in which the surface is horizontal.

5. The machine of claim 4, in which the machine additionally comprises removable roller transport assembly means for moving the container over the emptying table, said machine having a filling configuration when the roller transport assembly means are in place above the emptying table, and said machine further having an emptying configuration when the roller transport assembly means are removed from above the emptying table.

6. The machine of claim 5, in which the machine additionally comprises a collection hopper interposed between the edge of the emptying table and the air conveyor means, said collection hopper being for receipt of the filler material which leaves the edge of the emptying table and for presentation of the filler material to the air conveyor means.

7. An emptying table for use with a filler material dispensing and recycling machine, said emptying table comprising a surface for receipt of the contents of a container, said contents comprising filler material; said emptying table further comprising air means for directing a flow of air emanating from said air means over the surface and into the recycling machine, thereby urging the filler material of the contents, which have been placed on the surface, along the surface and into the recycling machine.

8. An emptying table for use with a filler material dispensing and recycling machine, said emptying table comprising a plenum for pressurization by a source of air, said plenum having an upper surface for receipt of the contents of a container said contents comprising filler material; said upper surface of said plenum having louver means for directing a flow of air from within the plenum, at an angle over the upper surface and into the recycling machine, thereby urging the filler material of the contents, which have been placed on the upper surface, along the upper surface and into the recycling machine.

9. The emptying table of claim 8, in which the louver means is a plurality of angled slits through the upper surface.

10. The emptying table of claims 8 or 9, in which the surface is horizontal.

11. The machine of claim 1, in which the surface is horizontal.

12. The emptying table of claim 7, in which the surface is horizontal.

13. A filler material dispensing and recycling machine, said recycling machine comprising:

a. filler material dispensing means for dispensing filler material into a container, said dispensing means comprising:

i. a filler material hopper for holding filler material, and ii. valve means attached to the filler material hopper for allowing the filler material to flow from the filler material hopper into the container.

b. an emptying table, said emptying table comprising a horizontal surface for receipt of the contents of the container, said contents comprising filler material, said emptying table further comprising air means for directing a flow of air over the surface toward an edge of the emptying table, thereby urging the filler material of the contents, which have been placed on the surface, along the surface and toward the edge of the emptying table;

c. air conveyor means for moving the filler material which leaves the edge of the emptying table into the filler material hopper; and d. removable roller transport assembly means for moving the container over the emptying table, said machine having a filling configuration when the roller transport assembly means are in place above the emptying table, and said machine further having an emptying configuration when the roller transport assembly means are removed from above the emptying table.

14. The machine of claim 13, in which the machine additionally comprises a collection hopper interposed between the edge of the emptying table and the air conveyor means, said collection hopper being for receipt of the filler material which leaves the edge of the emptying table and for presentation of the filler material to the air conveyor means.

* * * * *